United States Patent [19]

Guinea

[11] Patent Number: 4,658,781

[45] Date of Patent: Apr. 21, 1987

[54] KINETIC ENERGY UTILIZATION SYSTEM FOR USE WITH VEHICLES WITH INTERNAL COMBUSTION ENGINE

[76] Inventor: Jose M. R. Guinea, Pobla de Segur No. 18, 28033, Madrid, Spain

[21] Appl. No.: 786,699

[22] Filed: Oct. 11, 1985

[30] Foreign Application Priority Data

Oct. 22, 1984 [ES] Spain ..... 536.974

[51] Int. Cl.[4] ..... F02D 9/00; F02D 9/06; F02N 9/04

[52] U.S. Cl. ..... 123/325; 60/628; 123/179 F; 123/320

[58] Field of Search ..... 123/320–325, 123/179 F; 60/628

[56] References Cited

U.S. PATENT DOCUMENTS

| | | | |
|---|---|---|---|
| 1,013,528 | 1/1912 | Broderick | 60/628 X |
| 1,713,545 | 5/1929 | Miller | 123/320 |
| 2,509,942 | 5/1950 | Sanford | 123/179 F X |
| 2,876,876 | 3/1959 | Cummins | 123/325 X |
| 4,557,232 | 12/1985 | DeLorean | 123/179 F X |

FOREIGN PATENT DOCUMENTS

| | | | |
|---|---|---|---|
| 131826 | 8/1982 | Japan | 123/320 |

*Primary Examiner*—Tony M. Argenbright

[57] ABSTRACT

An energy conserving system for use with vehicles with an internal combustion engine and friction brakes includes a first valve in the air/fuel feed to the engine, a second valve in the exhaust line, a tank for pressurized air, and conduits between the tank and the valves. Actuation of a control system enables a first sensor to determine whether the brakes are being applied which opens the second valve to divert exhaust to the tank. During startup, the compressed air with or without fuel is used to reciprocate the pistons for a limited period after which fuel/air mixture feed at atmospheric pressure is commenced for normal engine operation. During engine startup, the brake sensor is not activated; and fuel supply to the engine is only cut while braking. However, fuel can be mixed with pressurized air from the pressure tank at any time depending upon accelerator position to make the engine work as a compressed air supplied engine or as a turbo combustion engine.

8 Claims, 1 Drawing Figure

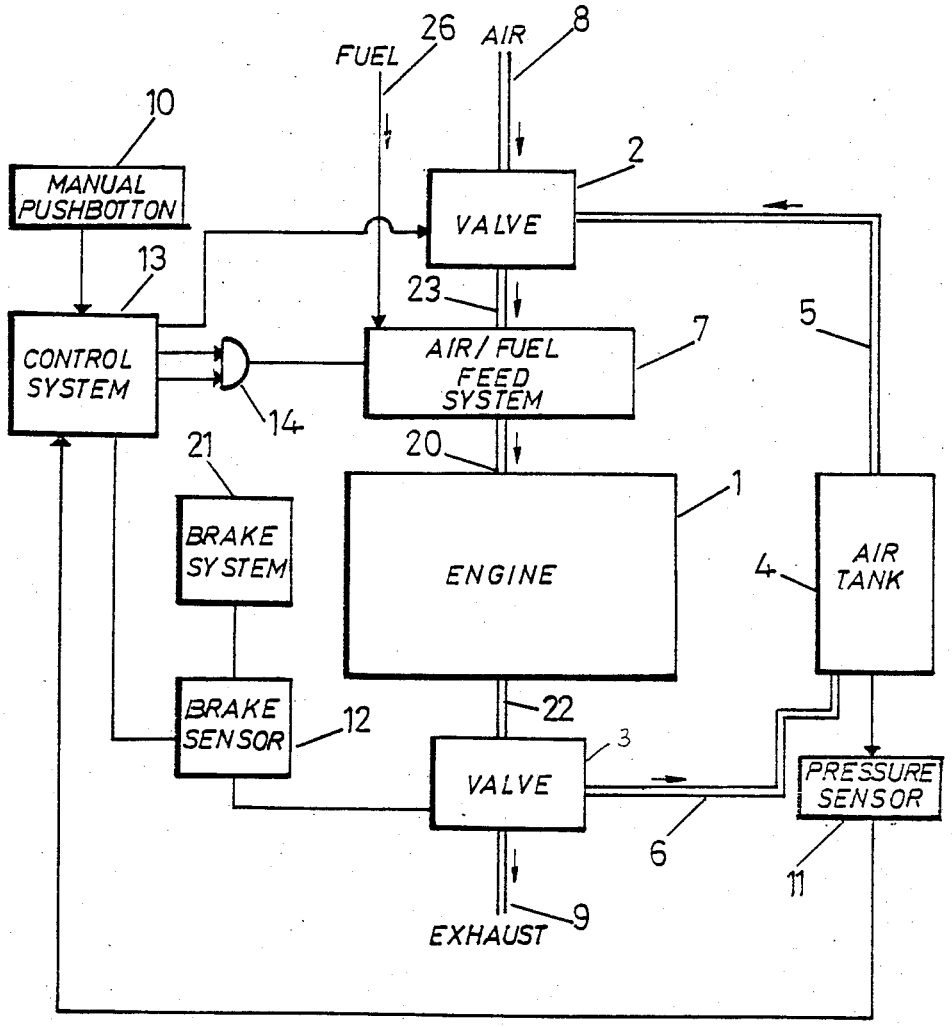
FUEL
26
AIR
8
10
MANUAL PUSHBOTTON
2
VALVE
13
23
CONTROL SYSTEM
AIR/FUEL FEED SYSTEM
7
5
14
21
20
1
BRAKE SYSTEM
ENGINE
4
AIR TANK
BRAKE SENSOR
12
22
3
VALVE
PRESSURE SENSOR
6
11
EXHAUST
9

KINETIC ENERGY UTILIZATION SYSTEM FOR USE WITH VEHICLES WITH INTERNAL COMBUSTION ENGINE

BACKGROUND OF THE INVENTION

The present invention is directed to apparatus for conserving kinetic energy in vehicles equipped with internal combustion engines and friction brakes.

As is known, the braking of a vehicle results in a loss of kinetic energy that has been generated to accelerate or maintain the vehicle at a given speed. Moreover, it is also known that the amount of pollutants generated by an internal combustion engine will vary with the fuel-/air mixture, and with the acceleration or deceleration of the engine.

It is an object of the present invention to provide a novel assembly capable of accumulating the energy being dissipated during braking for later use during the vehicle starting phase.

It is also an object to provide such an assembly which not only makes possible considerably energy savings, but also reduces atmospheric pollution due to engine emissions.

Another object is to provide such an assembly which will enable better deceleration over a longer period as a result of lower wearing of the brake pads.

Still another object is to provide such an assembly which may be used to start the vehicle in motion without using the vehicle's batteries.

A further object is to provide such an assembly in which the supply of compressed air may be used for various auxiliary applications.

A still further object is to provide such an assembly which increases safety as the vehicle descends a hill and which affords an emergency system to move the vehicle.

SUMMARY OF THE INVENTION

It has now been found that the foregoing and related objects and advantages can be readily attained in a novel apparatus for the conservation of kinetic energy during braking of an automobile having an internal combustion engine. This apparatus includes a first electrically operated valve adapted for connection in the air supply to the associated engine, and a second electrically operated valve adapted for connection in the exhaust system for the engine. A pressure tank for storing compressed air is connected to the said first and second valves, and a sensor is provided for sensing the actuation of the associated friction braking system. Another sensor is provided for determining the pressure of air stored in the pressure tank, and control means including switch means actuable by the operator is connected to each of the first and second valves, brake actuation sensor, tank pressure sensor and to the feed system for control of the flow of fuel mixture to the engine. This control means is operable to terminate the flow of fuel mixture and to admit air to the cylinders for compression therein, and the compressed air thus produced is diverted by the second valve to the pressure tank. The resistance to compression of the air in the cylinders slows the engine and thereby the vehicle.

In the preferred embodiment, the control means is operable to admit air under pressure from the pressure tank to the associated engine to effect reciprocation of the pistons both with or without combustion of fuel and thereby to provide motive power.

The first valve is operable by the control means between a first position in which it admits air from the atmosphere and a position in which it admits compressed air from the pressure tank.

Desirably, the control means is adapted to be coupled to an associated carburetor to terminate the flow of fuel therethrough while permitting flow of air therethrough.

BRIEF DESCRIPTION OF THE DRAWING

FIG. 1 is a schematic illustration of the apparatus of the present invention as combined with an automobile having an internal combustion engine and a friction braking system.

DETAILED DESCRIPTION OF THE PREFERRED EMBODIMENT

FIG. 1 schematically illustrates a motor vehicle employing the novel apparatus of the present invention to recapture and utilize some of the kinetic energy dissipated during braking. The apparatus is operatively coupled to the internal combustion engine 1 having a fuel-/air intake 20 and an exhaust port 22 for the gases discharged from the cylinders (not shown) of the engine 1.

In the feed conduit 8 to the intake 23 is a first electrically operable valve 2, and in the exhaust conduit 9 connected to the exhaust port 22 is a second electrically operable valve 3. The air/fuel feed system 7 connected to the intake 20 may be a carburetor, injector, pump or the like and is coupled to a conduit 26 for the combustible fuel, and a conduit or intake 23 for the conventional atmospheric air supply or pressurized air supply.

A compressed air tank 4 is connected by the conduit 5 to the valve 2, and by the conduit 6 to the valve 3.

The manual pushbutton 10 is mounted conveniently to the driver of the vehicle on the dashboard (not shown) and is functional to actuate a control system 13 which includes means for generating signals to the first valve 2 and second valve 3, as well as for receiving signals from the AND gate 14, the pressure sensor 11, and the brake sensor 12.

The pressure sensor 11 senses the pressure in the compressed air tank 4, and the brake sensor 12 senses when the braking system 21 is engaged. The logic circuit or control system 13 includes the AND gate 14 to control the supply of fuel from the feed system 7 to the engine 1.

In this block diagram there are not shown for the sake of simplicity elements that are common to any compressed air installation such as safety valves, check valves, etc.

In order to describe the operation of the novel installation, we assume an initial situation without compressed air in the tank 4 and in which the vehicle is operating normally with the internal combustion engine 1 receiving fuel/air mixture from the feed system 7 and discharging combustion gases through the exhaust system 9.

When the vehicle is moving and the brakes are applied, an electrical signal from the brake sensor 12 energizes the second valve 3 in the exhaust system 9. As a result, gases being exhausted are diverted from the engine to the pressure tank 4. Simultaneously, the AND gate 14 of the control circuit 13 is activated. When the pressure in the tank 4 is at a predetermined level, the sensor 11 provides a signal which satisfies the upper input of the gate 14 in the control system 13. The gate 14 will then provide an electrical signal which interrupts the fuel flow through the feeding system 7 to the engine 1.

Because of the continuing motion of the vehicle, the pistons in the engine 1 continue to reciprocate and draw in air from the atmosphere with essentially no fuel content. This air enters the engine 1 through the valve 2, is compressed by the pistons, and is discharged through the valve 3 to the tank 4. At the same time, the vehicle is gradually being stopped by this utilization of energy for the compression of the air. The final braking is achieved by the conventional friction brakes, which action may be delayed or reduced by the braking action of the compression system formed by the engine 1 and the valve 3.

In a second condition of operation represented by the starting of the engine 1, compressed air accumulated in the tank 4 during the previous phase, is diverted to the intake valve 2 by actuation of the pushbutton 10. The pressurized air is injected into the engine 1 intake, thus initiating vehicle motion since it will effect reciprocation of the pistons. With this system, the vehicle can start moving with only the compressed air from the tank 4. In this case, the pushbutton 10 is in the "on" condition, and the brake sensor 12 is in the "off" condition.

However, it is also possible to start movement of the vehicle through the normal starting system of the vehicle and then accelerating the engine 1 through the conventional internal combustion. This is done by having the pushbutton 10 in the "off" position. Similarly, the normal braking system may be used independently of the novel system of the present invention.

As will be appreciated, this novel system does not require either sophisticated electrically operated valves or the changing of the traditional engine design. The system may be added to existing vehicles without any major difficulties.

It will be appreciated that the above installation may be adapted to inject a mixture of fuel and compressed air at any moment during motion and not only while starting. This will enable more powerful engine operation. However, it will involve higher cost due to the need for a more complex electrically operated valve and possible engine redesign to allow greater working pressures in the cylinder; redesign of the feeding or carburetor system may be also necessary.

It will also be appreciated that the compressed air in the tank 4 may be utilized for other applications, such as the operation of accessories on the automobile, the inflation of tires, the operation of pneumatic devices, etc.

Thus, it can be seen that the present invention provides a relatively simple but effective energy conservation system for use with automobiles having internal combustion engines. Not only will it contribute to effective braking action, but also the compressed air produced can provide independent motive power, or enhance the combustion motive power and operate auxiliary apparatus.

Having thus described the invention, what is claimed is:

1. An apparatus for the conservation of kinetic energy during braking of an automobile having an internal combustion engine having a plurality of cylinders with a feed system for feeding fuel mixture to the cylinders of the engine for compression therein, the combination comprising:

a. a first electrically operated valve adapted for connection in the air supply to all of the cylinders of the associated engine;

b. a second electrically operated valve adapted for connection in the exhaust system for all of the cylinders of the engine;

c. a pressure tank for storing compressed air;

d. conduits between said pressure tank and said first and second valves;

e. a sensor for sensing the actuation of the associated friction braking system;

f. a sensor for determining the pressure of air stored in the pressure tank;

g. means for acting upon the fuel feed system to terminate flow of fuel therethrough; and h. control means including (i) electrical switch means actuable by the operator, and (ii) connections from said control means to each of said first and second valves for effecting electrical operation thereof, to said brake actuation sensor, tank pressure sensor and to the fuel terminating means in the feed system for control of the flow of fuel mixture to the engine, said control means being operable to terminate the flow of fuel and to admit air to each of the cylinders for compression therein, the compressed air thus produced in each of the cylinders being diverted by said second valve to said pressure tank, the resistance to compression of said air in the cylinders slowing the engine and thereby the vehicle.

2. The apparatus of claim 1 wherein said control means is operable to admit air under pressure tank to each of the cylinders of the associated engine to effect reciprocation of the pistons with or without combustion of fuel and thereby provide motive power.

3. The apparatus of claim 2 wherein said first valve is operable by said control means between a first position in which it admits air from the atmosphere and a second position in which it admits compressed air from said pressure tank.

4. The apparatus of claim 1 wherein said fuel terminating means is adapted to be coupled to an associated carburetor to terminate the flow of fuel therethrough while permitting flow of air therethrough.

5. In combination:

a. an automobile having:

i. an internal combustion engine having a plurality of cylinders with a feed system for feeding fuel mixture to the cylinders of the engine for compression therein;

ii. a friction braking system;

iii. a source of fuel connected to said fuel/air feeding means;

iv. an exhaust system; and b. a kinetic energy conservation system comprising:

i. a first electrically operated valve adapted for connection in the air supply to all of the cylinders of said engine;

ii. a second electrically operated valve adapted for connection in said exhaust system for all of the cylinders of said engine;

iii. a pressure tank for storing compressed air;

iv. conduits between said pressure tank and said first and second valves;

v. a sensor for sensing the actuation of the said friction braking system;

vi. a sensor for determining the pressure of air stored in said pressure tank;

vii. means for acting upon the fuel feed system to terminate flow of fuel therethrough; and viii. control means including (a) electrical switch means actuable by the operator, and (b) connections from said control means to each of said first and second valves for effecting electrical operation thereof, to said brake actuation sensor, to said tank pressure sensor and to said fuel terminating means in said fuel/air feeding means for control of the flow of fuel mixture to said engine, said control means being operable to terminate the flow of fuel and to admit air to each of the cylinders for compression therein, the compressed air thus produced in each of the cylinders being diverted by said second valve to said pressure tank, the resistance to compression of said air in the cylinders slowing said engine and thereby the vehicle.

6. The combination in accordance with claim 5 wherein said control means is operable to admit air under pressure from said pressure tank to each of the cylinders of said engine to effect reciprocation of the pistons with or without combustion of fuel and thereby provide motive power.

7. The combination in accordance with claim 6 wherein said first valve is operable by said control means between a first position in which it admits air from the atmosphere and a second position in which it admits compressed air from said pressure tank.

8. The combination in accordance with claim 5 wherein said fuel flow terminating means is coupled to said fuel feeding means to terminate the flow of fuel therethrough while permitting flow of air therethrough.

* * * * *